US011851252B2

(12) United States Patent
Boukredine

(10) Patent No.: US 11,851,252 B2
(45) Date of Patent: Dec. 26, 2023

(54) CARTON AND CARTON BLANK

(71) Applicant: WestRock Packaging Systems, LLC, Atlanta, GA (US)

(72) Inventor: Eric Boukredine, Ambrault (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 475 days.

(21) Appl. No.: 17/270,422

(22) PCT Filed: Aug. 16, 2019

(86) PCT No.: PCT/US2019/046774

§ 371 (c)(1),
(2) Date: Feb. 22, 2021

(87) PCT Pub. No.: WO2020/041118

PCT Pub. Date: Feb. 27, 2020

(65) Prior Publication Data

US 2021/0179314 A1 Jun. 17, 2021

Related U.S. Application Data

(60) Provisional application No. 62/720,652, filed on Aug. 21, 2018.

(51) Int. Cl.

| | |
|---|---|
| ***B65D 5/02*** | (2006.01) |
| ***B65D 5/46*** | (2006.01) |
| ***B65D 71/36*** | (2006.01) |

(52) U.S. Cl.

CPC ..... *B65D 5/029* (2013.01); *B65D 5/0227* (2013.01); *B65D 5/46192* (2013.01);
(Continued)

(58) Field of Classification Search

CPC .... B65D 5/3628; B65D 5/029; B65D 5/0227; B65D 5/46192; B65D 71/36; B65D 2571/00172; B65D 2571/00728

See application file for complete search history.

(56) References Cited

U.S. PATENT DOCUMENTS

| | | | | |
|---|---|---|---|---|
| 3,904,036 A | | 9/1975 | Forrer | |
| 6,065,590 A | * | 5/2000 | Spivey | B65D 71/36 206/427 |
| 2009/0065559 A1 | | 3/2009 | Parkes | |

FOREIGN PATENT DOCUMENTS

| | | |
|---|---|---|
| DE | 4217111 A1 | 11/1993 |
| WO | WO-9700212 A1 | 1/1997 |

(Continued)

OTHER PUBLICATIONS

International Search Report and Written Opinion for PCT Application No. PCT/2019/046774, dated Oct. 22, 2019.

*Primary Examiner* — Stephen J Castellano
(74) *Attorney, Agent, or Firm* — Brian J. Goldberg; Rohini K. Garg

(57) ABSTRACT

A carton (90) for packaging one or more articles. The carton includes a plurality of walls which extend at least partially around an interior of the carton. The plurality of walls includes at least one of top (18) and bottom (12, 24) walls, a pair of opposed side walls (14, 16 and 20, 22) and a pair of opposed end walls (26*a*, 28*a*, 30*a*, 34*a* and 26*b*, 28*b*, 30*b*, 34*b*). Each of the side walls has opposed upper (17, 19) and lower edges (13, 23). The upper edges of the side walls are disposed at a first distance (d1) from each other. The lower edges of the side walls are disposed at a second distance (d2) from each other. The first distance is substantially different from the second distance. Each of the end walls includes an upper end strap (28*b*, 30*b*) and a lower end strap (26*b*, 34*b*).

13 Claims, 6 Drawing Sheets

(52) U.S. Cl.
CPC ..... *B65D 71/36* (2013.01); *B65D 2571/0066* (2013.01); *B65D 2571/00172* (2013.01); *B65D 2571/00462* (2013.01); *B65D 2571/00475* (2013.01); *B65D 2571/00728* (2013.01); *B65D 2571/00932* (2013.01)

(56) References Cited

FOREIGN PATENT DOCUMENTS

| | | | |
|---|---|---|---|
| WO | WO-2016054466 | A1 | 4/2016 |
| WO | WO-2016183265 | A1 | 11/2016 |

* cited by examiner

CARTON AND CARTON BLANK

CROSS REFERENCE TO RELATED APPLICATIONS

This Application is the U.S. National Stage of PCT International Application No. PCT/US2019/046774, filed Aug. 16, 2019, which claims the benefit of U.S. Provisional Application 62/720,652 filed on Aug. 21, 2018. The entire disclosures of these applications are incorporated herein by reference in their entirety.

TECHNICAL FIELD

The present invention relates to a carton and blank for forming the same. More specifically, but not exclusively, aspects of the present invention relate to a carton of the gable top style which is collapsible and/or automatically erectable.

BACKGROUND

In the field of packaging it is often required to provide consumers with a package comprising multiple primary product containers. Such multi-packs are desirable for shipping and distribution purposes and for the display of promotional information. For cost and environmental considerations, such cartons or carriers need to be formed from as little material as possible and cause as little wastage as possible in the materials from which they are formed. Another consideration is the strength of the packaging and its suitability for holding and transporting large weights of articles.

It is desirable to provide a carton which is collapsible so as to be automatically erectable from a flat collapsed sleeve form.

The present invention seeks to overcome or at least mitigate the problems of the prior art.

SUMMARY

According to a first aspect of the present disclosure there is provided a carton for packaging one or more articles. The carton comprises a plurality of walls which extend at least partially around an interior of the carton. The plurality of walls includes at least one of a top and bottom wall, a pair of opposed side walls and a pair of opposed end walls. Each of side wall of the pair of side walls has opposed upper and lower edges. The upper edges of the side walls are disposed at a first distance (d1) from each other. The lower edges of the side walls being disposed at a second distance (d2) from each other. The first distance (d1) may be substantially different to the second distance (d2). Each of the end walls may comprise an upper end strap and a lower end strap. Each lower end strap is separate from, and has no direct connection with, the adjacent one of the upper end straps. Each of the at least one of the top and bottom walls, the upper end straps and the lower end straps is provided with a centre fold line such that the carton is collapsible into a flat collapsed form by folding the at least one of the top and bottom wall, the upper end straps and the lower end straps about their respective centre fold lines.

Advantageously, the carton may be automatically erected from the flat collapsed state to form a sleeve open at one end and closed at the other opposing end. The carton may comprise at least one panel for at least partially closing the open end once the sleeve is loaded with one or more articles.

Optionally, the carton comprises a top wall and the upper edge of a first side wall is defined by a first fold line between the first side wall and the top wall.

Optionally, the carton comprises a bottom wall and the lower edge of a first side wall is defined by a second fold line between the first side wall and the bottom wall.

Optionally, the upper edge of the second side wall is defined by a third fold line between the second side wall and the top wall.

Optionally, the lower edge of the second side wall is defined by a fourth fold line between the second side wall and the bottom wall.

Optionally, the first distance (d1) is smaller than the second distance (d2).

Optionally, each upper end strap comprises: a first upper end closure panel; a second upper end closure panel; an upper strap securing panel; and a hinged connection forming a centre fold line.

Optionally, each upper end strap comprises: a first upper end closure panel hinged to the first side wall; a second upper end closure panel hinged to the second side wall; and an upper strap securing panel hingedly connected to one of the first and second upper end closure panels by a centre fold line.

Optionally, each lower end strap comprises: a first lower end closure panel; a second lower end closure panel; a lower strap securing panel; and a hinged connection forming a centre fold line.

Optionally, each lower end strap comprises: a first lower end closure panel hinged to the first side wall; a second lower end closure panel hinged to the second side wall; and a lower strap securing panel hingedly connected to one of the first and second upper end closure panels by a centre fold line.

Optionally, each upper end strap is shaped and arranged to avoid collision with the adjacent lower end strap when the carton is erected from its flat collapsed form.

Optionally, each upper end strap is shaped and arranged to partially overlap with the adjacent lower end strap when the carton is erected.

According to a second aspect of the present disclosure there is provided a blank for forming a carton. The blank comprises a plurality of panels for defining an interior chamber for receiving one or more articles. The plurality of panels includes at least one of a top and bottom panel and a pair of opposed side panels. Each of the side panels of said pair of opposed side panels has opposed upper and lower edges. The upper edges of the side panels being disposed at a first distance (d1) from each other and the lower edges of the side panels being disposed at a second distance (d2) from each other in a setup carton. The first distance (d1) is substantially different to the second distance (d2). The blank comprises end closure panels for forming an upper end strap and a lower end strap at each end of the setup carton. Each lower end strap is separate from, and has no direct connection with, the adjacent one of the upper end straps. Each of the at least one of the top and bottom panel, the upper end straps and the lower end straps is provided with a centre fold line such that the carton is collapsible into a flat collapsed form by folding the at least one of the top and bottom panel, the upper end straps and the lower end straps about their respective centre fold lines.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
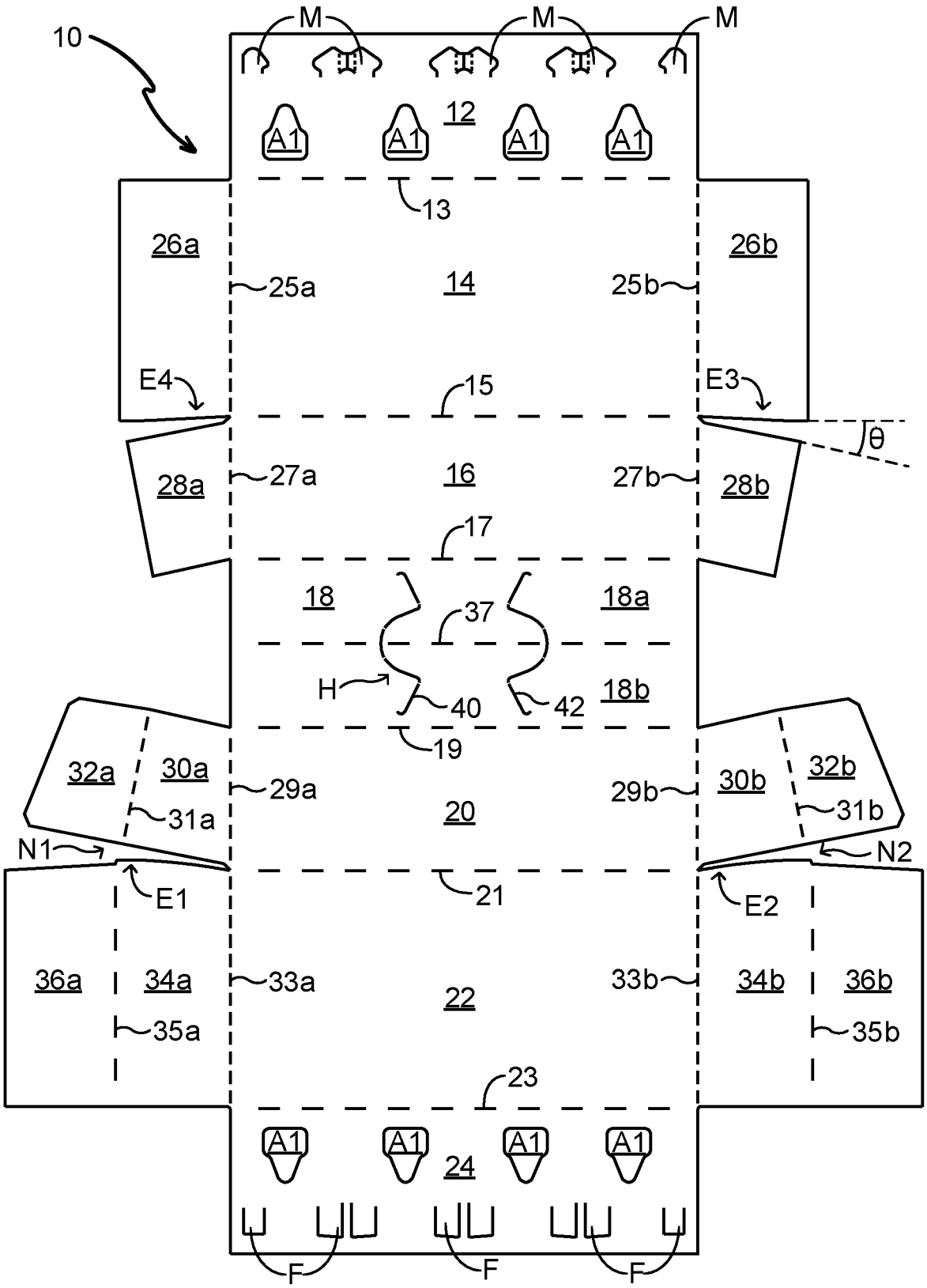
FIG. 1 is a plan view from above of a blank for forming a carton according to an embodiment of the invention.
Figure 4:
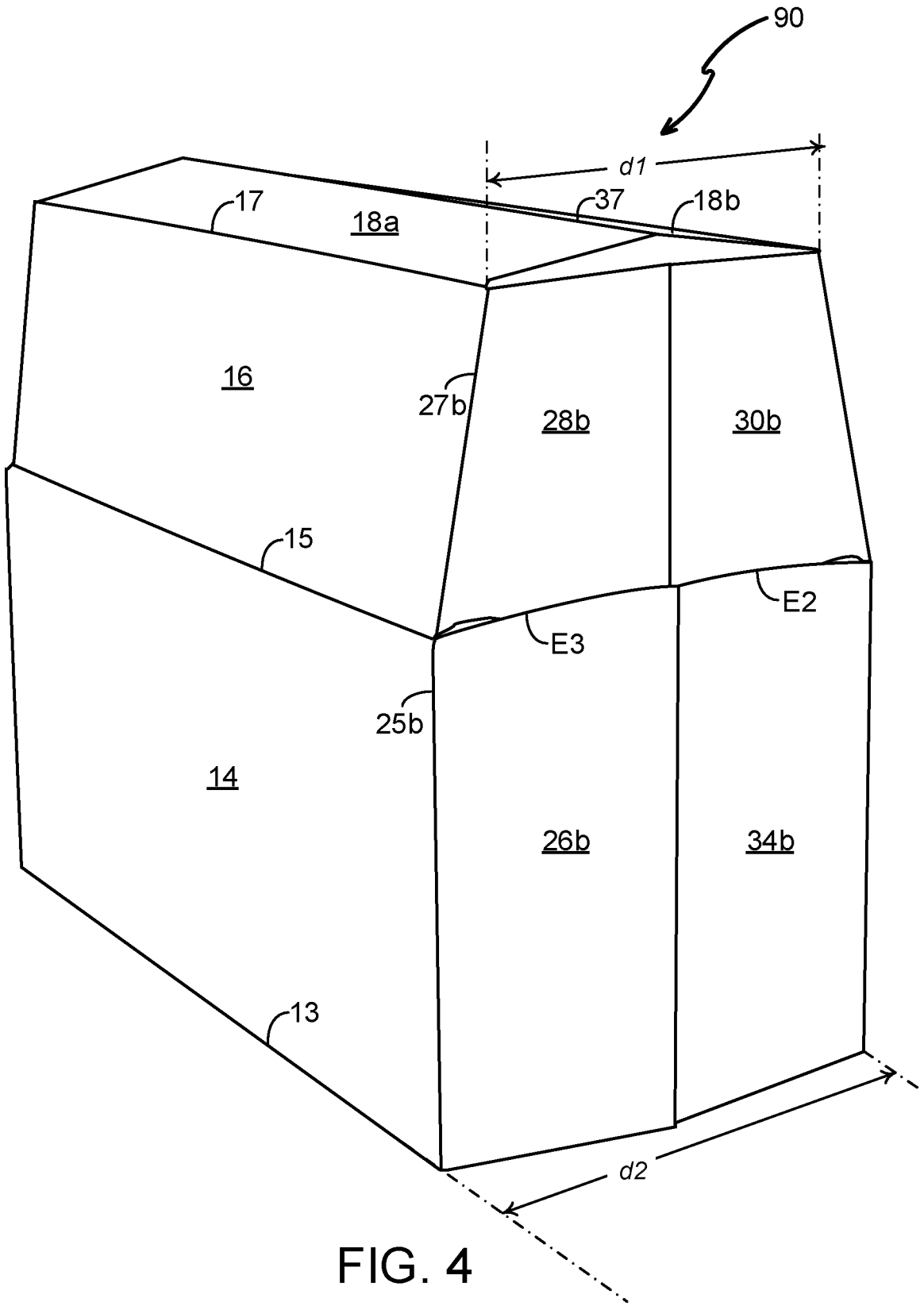
FIG. 4 is a perspective view from above of a carton formed from the blank of FIG. 1.

Referring to FIGS. 1 and 4 there is shown a blank 10 for forming a carton 90. The carton 90 (see FIG. 4) is capable of accepting an input of primary products such as, but not limited to, bottles or cans, hereinafter referred to as articles (not shown).

The blank 10 comprises a plurality of main panels 12, 14, 16, 18, 20, 22, 24 hinged one to the next in a linear series. A first base panel 12 is hinged to a first lower side wall panel 14 by a hinged connection such as a fold line 13. The first lower side wall panel 14 is hinged to a first upper side wall panel 16 by a hinged connection such as a fold line 15. A top panel 18 is hinged to first upper side wall panel 16 by a hinged connection in the form of a fold line 17.

The top panel 18 is hinged to a second upper side wall panel 20 by a hinged connection such as a fold line 19. The second upper side wall panel 20 is hinged to a second lower side wall panel 22 by a hinged connection in the form of a fold line 21. A second base panel 24 is hinged to the second lower side wall panel 22 by a hinged connection such as a fold line 23.

The first lower side wall panel 14 and first upper side wall panel 16 together form a first side wall 14/16 of the carton 90. The second lower side wall panel 22 and second upper side wall panel 20 together form a first side wall 20/22 of the carton 90.

The plurality of main panels 12, 14, 16, 18, 20, 22, 24 of the blank 10 form walls of a tubular structure in a set-up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment the ends of the tubular structure are fully closed by end closure panels 26*a*, 28*a*, 30*a*, 32*a*, 34*a*, 36*a* 26*b*, 28*b*, 30*b*, 32*b*, 34*b*, 36*b*.

End closure panels 26*a*, 28*a*, 30*a*, 32*a*, 34*a*, 36*a* are configured to close a first end of the tubular structure; and end closure panels 26*b*, 28*b*, 30*b*, 32*b*, 34*b*, 36*b* are configured to close a second end of the tubular structure.

Figure 3:
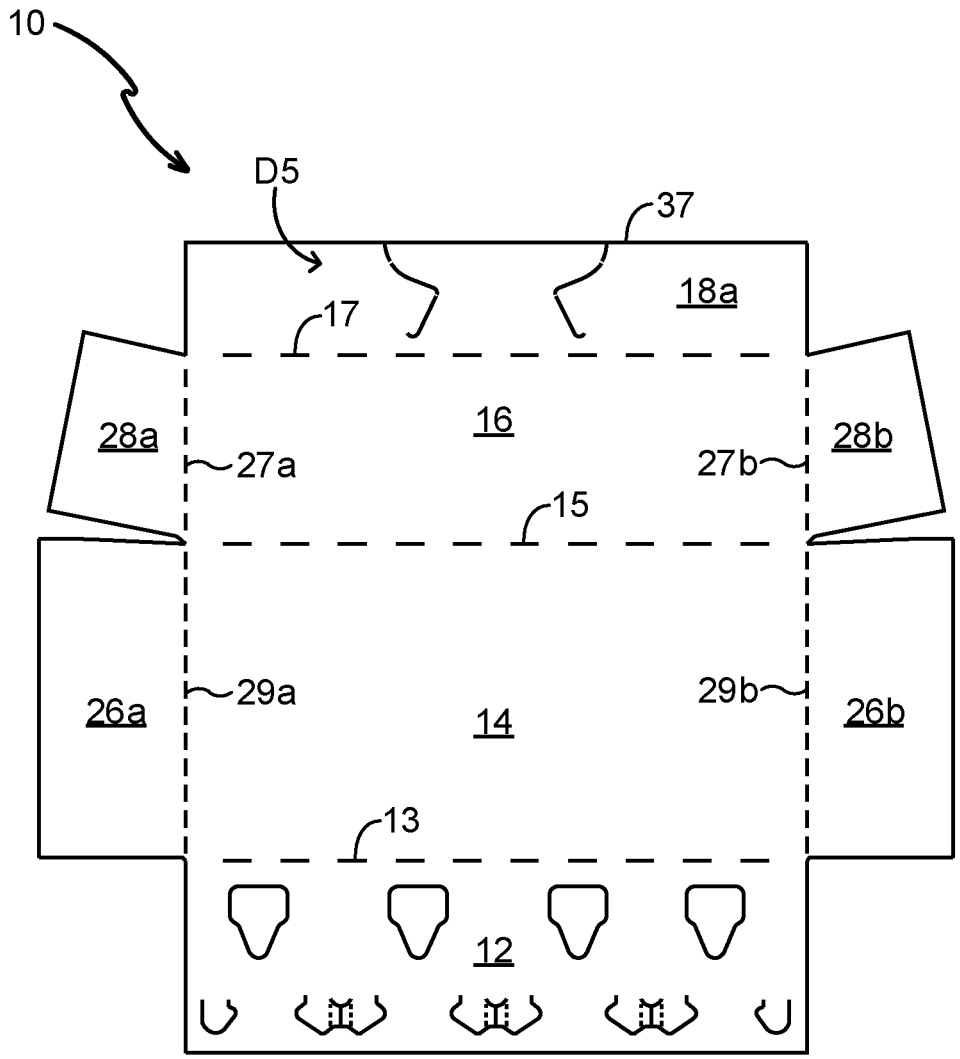
FIG. 3 illustrates another stage of construction of the blank of FIG. 1, to form a flat collapsed carton.

The end closure panels 26*a*, 28*a*, 30*a*, 32*a*, 34*a*, 36*a* 26*b*, 28*b*, 30*b*, 32*b*, 34*b*, 36*b* are configured to be collapsible into a flat sleeve, as shown in FIG. 3. The end closure panels 26*a*, 28*a*, 30*a*, 32*a*, 34*a*, 36*a*, 26*b*, 28*b*, 30*b*, 32*b*, 34*b*, 36*b* may be automatically erected to close respective ends of the tubular structure formed by the plurality of main panels 12, 14, 16, 18, 20, 22, 24.

The first end of the tubular structure is closed by a first end closure panel 26*a*; a second end closure panel 28*a*; a third end closure panel 30*a*; and a fourth end closure panel 34*a*. The first end closure panel 26*a* is hinged to a first end of the first lower side panel 14 by a hinged connection such as a fold line 25*a*. The second end closure panel 28*a* is hinged to a first end of the first upper side wall panel 16 by a hinged connection such as a fold line 27*a*. The third end closure panel 30*a* is hinged to a first end of the second upper side panel 20 by a hinged connection such as a fold line 29*a*. A first securing panel 32*a* is hinged to the third end closure panel 30*a* by a hinged connection such as a fold line 31*a*. The fourth end closure panel 34*a* is hinged to a first end of the second lower side wall panel 22 by a hinged connection such as a fold line 33*a*. A second securing panel 36*a* is hinged to the fourth end closure panel 34*a* by a hinged connection such as a fold line 35*a*.

The second end of the tubular structure is closed by: a fifth end closure panel 26*b*; a sixth end closure panel 28*b*; a seventh end closure panel 30*b*; and an eighth end closure panel 34*b*. The fifth end closure panel 26*b* is hinged to a second end of the first lower side panel 14 by a hinged connection such as a fold line 25*b*. The sixth end closure panel 28*b* is hinged to a second end of the first upper side wall panel 16 by a hinged connection such as a fold line 27*b*. The seventh end closure panel 30*b* is hinged to a second end of the second upper side panel 20 by a hinged connection such as a fold line 29*b*. A third securing panel 32*b* is hinged to the seventh end closure panel 30*b* by a hinged connection such as a fold line 31*b*. The eighth end closure panel 34*b* is hinged to a second end of the second lower side wall panel 22 by a hinged connection such as a fold line 33*b*. A fourth securing panel 36*b* is hinged to the eighth end closure panel 34*b* by a hinged connection such as a fold line 35*b*.

The top panel 18 comprises a longitudinal fold line 37 disposed to bisect the top panel 18 into a first part 18*a* and a second part 18*b*. The longitudinal fold line 37 may fully extend across the top panel 18 or may substantially extend across a majority of the top panel 18, either continuously or in an interrupted matter.

Optionally, the blank 10 comprises a carrying handle H defined at least in part in the top panel 18. The carrying handle H comprises a pair of severance lines 40, 42 which define a strap extending transversely of the top panel 18. A user may engage one or both sides of the strap in order to carry the carton 90. Alternatively, a user may engage one or both of the portions of the top panel 18 disposed either side of the strap.

In alternative embodiments, the handle structure may be omitted or alternative handle structures may be employed.

The first and second base panels 12, 24 are engageable with one another in an overlapping relationship to form a composite base wall 12/24 of the carton 90. The blank 10 may comprise a complementary locking mechanism for securing the first base panel 12 to the second base panel 24. The first base panel 12 may comprise at least one first part M of the complementary locking mechanism. The second base panel 24 may comprise at least one second part F of the complementary locking mechanism. In the illustrated embodiment, the first base panel 12 comprises five male tabs M struck therefrom so as to be defined within the first base panel 12. Each of the male tabs M is hingedly connected to the first base panel 12.

The second part F of the complementary locking mechanism forms a receiver. The receiver comprises an opening or slot for receiving the male tab M. The second base panel 24 optionally comprises five female tabs each defining and forming an opening or slot in the second base panel 24. Once displaced out of the plane of the second base panel 24, the female tabs F each form at least part of the receiver. The openings in the second base panel 24 are configured to receive respective ones of the male tabs M.

The female tabs F are arranged to be displaced out of the second base panel 24 to form said openings and to bear against a respective male tab M when received therein. In some embodiments the complementary locking mechanism M/F may be omitted, the first and second base panels 12, 24 may be secured to each other by any other suitable means, such as, but not limited to, adhesive or staples and/or by any other suitable mechanical interlocking mechanism.

Optionally, the first and second base panels 12, 24 may comprise at least one aperture A1. In the illustrated embodiment, the first base panel 12 comprises four apertures A1 and the second base panel 24 comprises four apertures A1. The apertures A1 may be employed to facilitate construction of the carton 90. A packaging machine used for automated assembly of the blank 10 into a carton 90 or collapsed carton 90 may comprise a component or tool which may engage with the apertures A1 to facilitate alignment of the first and second base panels 12, 24 with respect to each other or to align the first part M of the complementary locking mechanism with the second part F of the complementary locking mechanism. The complementary locking mechanism illustrated and described is entirely optional.

The carton 90 can be formed by a series of sequential folding operations, optionally, in a straight line machine so that the carton 90 may not be required to be rotated or inverted to complete its construction. The folding process is not limited to that described below and may be altered according to particular manufacturing requirements.

Figure 2:
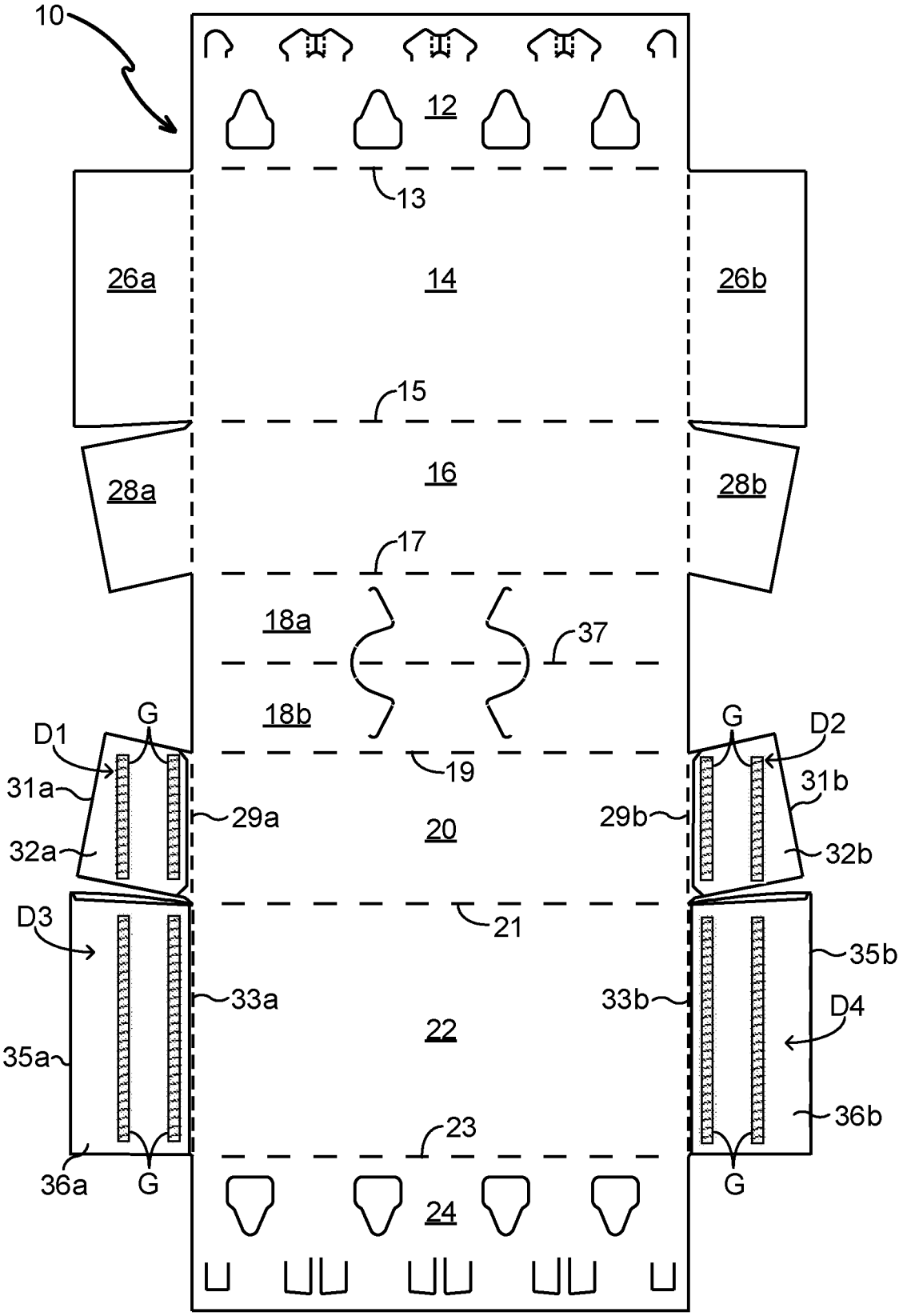
FIG. 2 illustrates a stage of construction of a carton from the blank of FIG. 1.

Turning to the construction of the carton 90 as illustrated in FIG. 2, the blank 10 is folded about the fold line 31*a* such that the first securing panel 32*a* is disposed in overlying relationship with the third end closure panel 30*a*, as indicted by direction arrow D1.

The blank 10 is folded about the fold line 31*b* such that the third securing panel 32*b* is disposed in overlying relationship with the seventh end closure panel 30*b*, as indicted by direction arrow D2.

The blank 10 is further folded about the fold line 35*a* such that the second securing panel 36*a* is disposed in overlying relationship with the fourth end closure panel 34*a*, as indicted by direction arrow D3.

The blank 10 is folded about the fold line 35*b* such that the fourth securing panel 36*b* is disposed in overlying relationship with the eighth end closure panel 34*b*, (as indicted by direction arrow D4).

Glue G or other adhesive treatment is applied to appropriate areas, strips or regions of an outer surface (upper surface shown in FIG. 2) of each of the first, second, third and fourth securing panels 32*a*, 36*a*, 32*b*, 36*b*. Alternatively, glue G or other adhesive treatment may be applied to a corresponding portion of an inner surface of the first, second, fifth and sixth end closure panels 26*a*, 28*a*, 26*b*, 28*b*.

The blank 10 is folded about the fold line 37, as shown indicated in FIG. 3 by direction arrow D5, such that: the first base panel 12 is disposed in overlying relationship with the second base panel 24; the first lower side panel 14 is disposed in overlying relationship with the second lower side panel 22; the first upper side panel 16 is disposed in overlying relationship with the second upper side panel 20; and the first part 18*a* of the top panel 18 is disposed in overlying relationship with the second part 18*b* of the top panel 18.

Additionally, in folding the blank 10 about fold line 37, the first end closure panel 26*a* is brought into face contacting relationship with the second securing panel 36*a*, so as to overly the second securing panel 36*a* and the fourth end closure panel 34*a*.

The first end closure panel 26*a* is secured to the second securing panel 36*a*.

The second end closure panel 28*a* is brought into face contacting relationship with the first securing panel 32*a*, so as to overly the first securing panel 32*a* and the third end closure panel 30*a*.

The second end closure panel 28*a* is secured to the first securing panel 32*a*.

The fifth end closure panel 26*b* is brought into face contacting relationship with the fourth securing panel 36*b*, so as to overly the fourth securing panel 36*b* and the eighth end closure panel 34*b*.

The fifth end closure panel 26*b* is secured the fourth securing panel 36*b*.

The sixth end closure panel 28*b* is brought into face contacting relationship with the third securing panel 32*b*, so as to overly the third securing panel 32*b* and the seventh end closure panel 30*b*.

The sixth end closure panel 28*b* is secured to the third securing panel 32*b*.

The blank 10 is thus formed into a flat collapsed tubular structure which can be readily shipped or distributed to a convertor plant, at which the flat collapsed tubular structure may be erected into an open-ended tubular structure and loaded with articles.

The flat collapsed tubular structure may be erected to form a sleeve, open at one end thereof, by separating the first side wall panel 14/16 from the second side wall panel 20/22. In doing so the top panel 18 is unfolded (about fold line 37) such that the first part 18*a* and the second part 18*b* are substantially coplanar.

A first end wall is formed by the end closure panels 26*a*, 28*a*, 30*a*, 34*a* disposed at a first end of the blank 10. A second end wall is formed by the end closure panels 26*b*, 28*b*, 30*b*, 34*b* disposed at a first end of the blank 10.

The top panel 18 is automatically erected as are the first and second end walls of the carton 90.

The sleeve, in its erected form, may be loaded with articles through the opening at the base.

In alternative embodiments the opening may be provided at the top or upper end of the sleeve, the sleeve may be top loaded, that is to say loaded through the opening at the upper end by relative movement between the articles and the sleeve. The sleeve may be inverted such that the top panel 16 becomes a base panel, and the first and second base panels 12, 24 become first and second top panels and together form a composite top panel. In some embodiments, the positions of the first upper side panel 16 and the first lower side panel 14 may also be transposed and likewise the positions of the second upper side panel 20 and the second lower side panel 22 may be transposed such that the resulting alternative carton is tapered towards the composite top panel, in this way the alternative carton may maintain the gable top style.

Once the sleeve has been loaded with articles the open base of the sleeve is closed to form the carton 90 shown in FIG. 4.

The sleeve is closed by folding the second base panel 24 about fold line 23. The first base panel 12 is then folded about the fold line 13 to be brought into contact with the second base panel 24. The first base panel 12 is secured to the second base panel 24. This may be achieved by engaging the first parts M of the complementary locking mechanism with respective second parts F.

In other embodiments, alternative securing means may be employed to secure the first and second base panels 12, 24, for example, but not limited to, mechanical securing devices such as staples or use of glue or adhesive treatments.

Figure 5C:
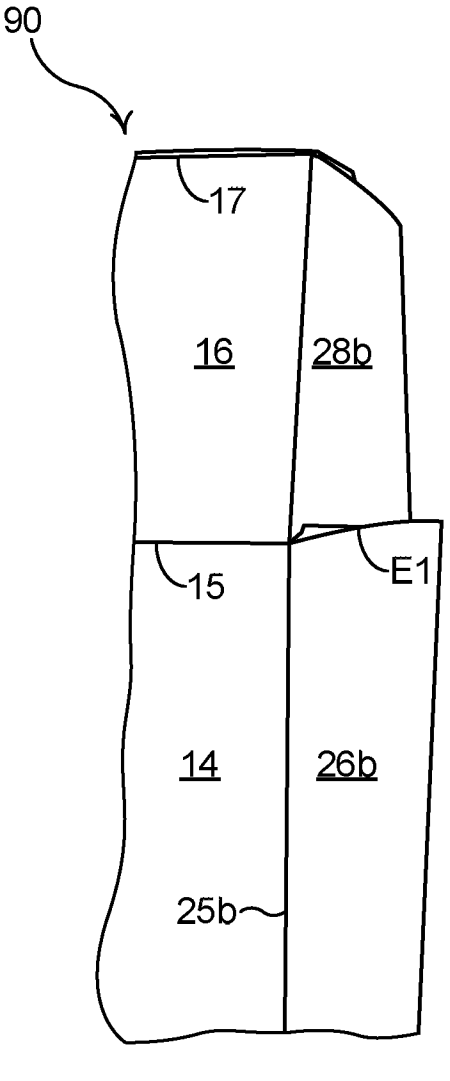
FIGS. 5A to 5C and 6 illustrate a portion of the flat collapsed carton of FIG. 3 in various stages of erection.
Figure 5B:
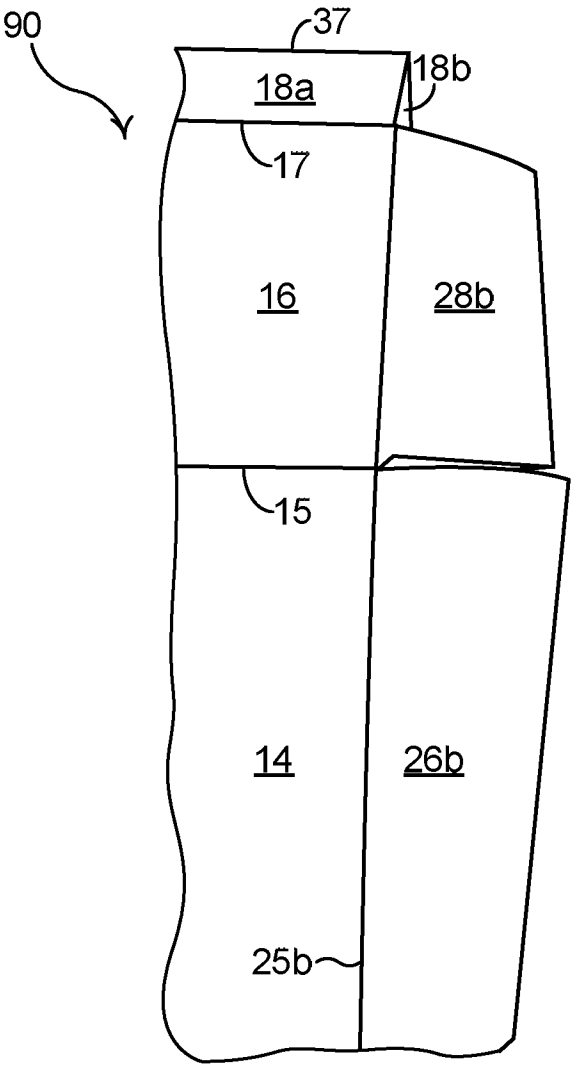
Figure 5A:
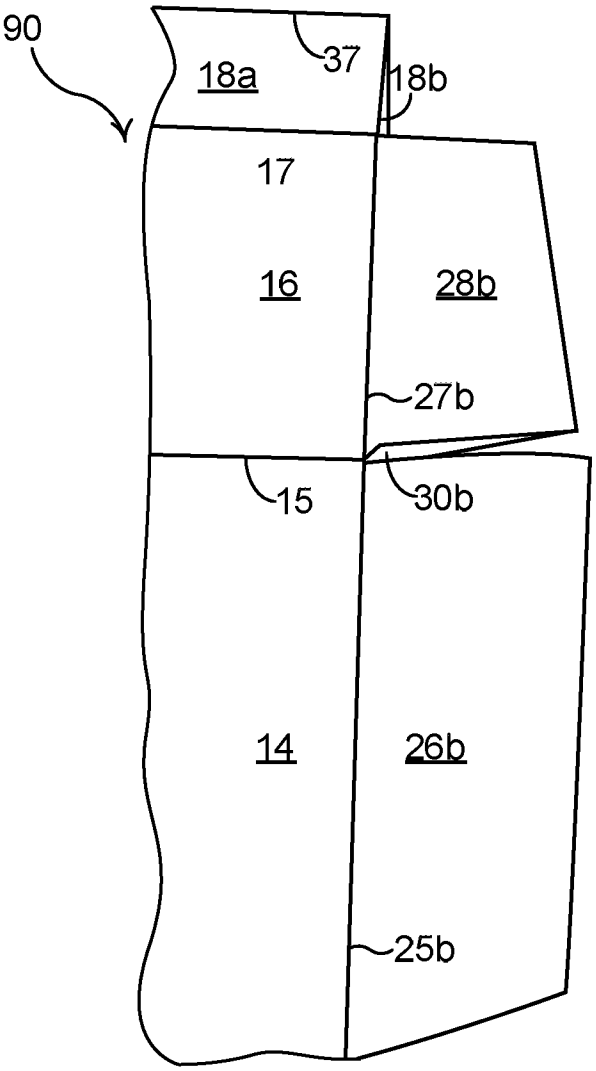
Figure 6:
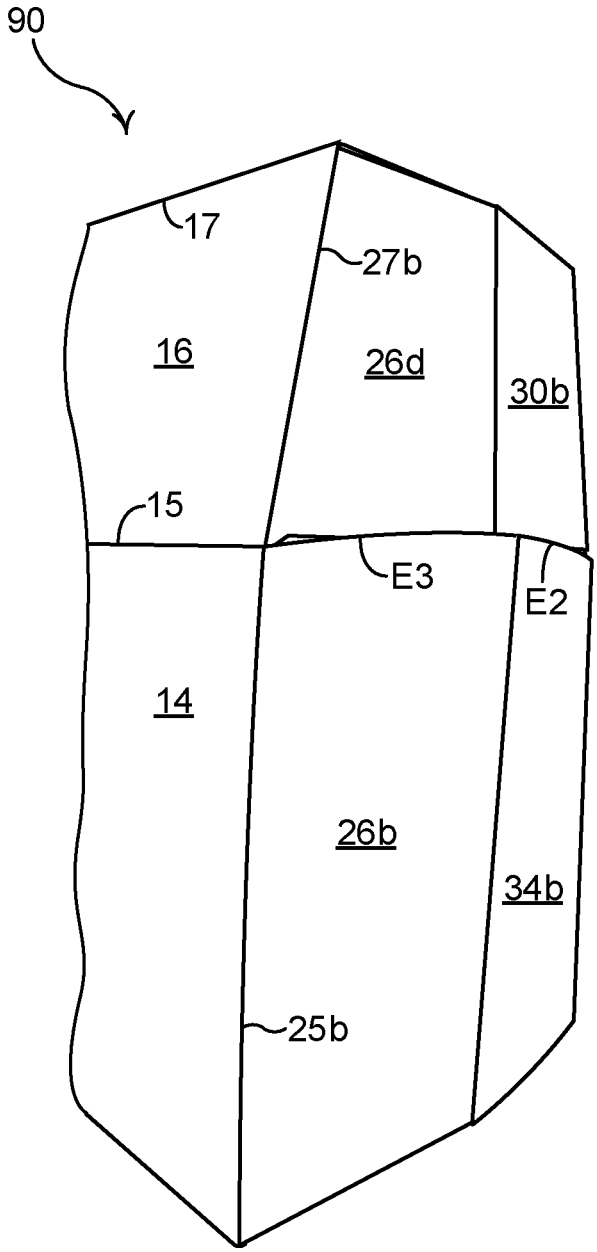

FIGS. 5A to 5B and FIG. 6 show a second end of the carton 90 during the erection process between the "flat collapsed sleeve form" and "the erected sleeve form".

The sixth and seventh end closure panels 28*b*, 30*b* form a second upper end strap or wall 28*b*/30*b*; and are secured to each other via the third securing panel 32*b*. The third securing panel 32*b* has the effect of hinging the sixth end closure panel 28*b* to the seventh end closure panel 30*b*.

The fifth and eighth end closure panels 26*b*, 34*b* form a second lower end strap or wall 26*b*/34*b*; and are secured to each other via the fourth securing panel 34*b*. The fourth securing panel 34*b* has the effect of hinging the fifth end closure panel 26*b* to the eighth end closure panel 34*b*.

Optionally, the sixth and seventh end closure panels 28*b*, 30*b* are arranged such the second upper end wall 28*b*/30*b* and the second lower end wall 26*b*/34*b* do not collide during the erection process.

Optionally, the sixth and seventh end closure panels 28*b*, 30*b* are arranged such that they are shorter in height than the first and second upper side wall panel 16, 20. This is achieved by insetting the lower edges of the sixth and seventh end closure panels 28*b*, 30*b* along the majority of their respective lengths. This provides clearance between the second upper end wall 28*b*/30*b* and the second lower end wall 26*b*/34*b* during erection.

In some embodiments, insetting the lower edges of the sixth and seventh end closure panels 28*b*, 30*b* would create a gap between the second upper end wall 28*b*/30*b* and the second lower end wall 26*b*/34*b*, when the sleeve is erected. In order to avoid or mitigate against this upper edges E3, E2 of the fifth and eighth end closure panels 26*b*, 34*b* are shaped to significantly close said gap as best shown in FIG. 6. The upper edges E3, E2 are optionally curvilinear in shape. In alternative embodiments other shapes may be employed. The upper edges E3, E2 are arranged such that the fifth and eighth end closure panels 26*b*, 34*b* are greater in height than the first or second lower side wall panel 16, 22. The height of the fifth and eighth end closure panels 26*b*, 34*b* increases towards the centre of the carton 90. In this way the fifth and eighth end closure panels 26*b*, 34*b* at least partially overlap with a respective one of the sixth and seventh end closure panels 28*b*, 30*b*.

In this way the second lower end wall 26*b*/34*b* extends upwardly to close the gap which would otherwise be present between second upper end wall 28*b*/30*b* and the second lower end wall 26*b*/34*b*.

The sixth and seventh end closure panels 28*b*, 30*b* are arranged such the upper end wall 28*b*/30*b* is disposed internally of the second lower end wall 26*b*/34*b*.

The sixth and seventh end closure panels 28*b*, 30*b* (similarly to the second and third end closure panels 28*a*, 30*a*) are trapezoidal in shape. The sixth and seventh end closure panels 28*b*, 30*b* are tapered in shape with opposed side edges converging towards an upper edge. The upper and lower edges are substantially parallel to each other.

An upper edge of each of the second and fourth securing panels 36*a*, 36*b* is notched or recessed (see references N1, N2 in FIGS. 1 and 6) with respect to the upper edge E1, E2 of the fourth and eighth end closure panel 34*a*, 34*b* to which they are hingedly connected. In this way the fourth securing panel 36*b* is spaced apart from the sixth end closure 28*b* when erected. The fourth securing panel 36*b* does not overlap with the sixth end closure 28*b* when erected.

In alternative embodiments, the arrangement of the second upper end wall 28*b*/30*b* and the second lower end wall 26*b*/34*b* may be reversed. The second upper end wall 28*b*/30*b* may be arranged to be disposed outermost.

The second upper end wall panels 28*b*, 30*b* may be arranged to be taller than the respective first and second upper side panel 16, 20 to which they are hingedly connected. The second lower end wall panels 26*b*, 34*b* may be arranged to be shorter than the respective first and second lower side panel 14, 22 to which they are hingedly connected. In this way the second upper end wall 28*b*/30*b* may extend downwardly to close the gap which would otherwise be present between second upper end wall 28*b*/30*b* and the second lower end wall 26*b*/34*b*.

It will be appreciated that the second and third end closure panels 28*a*, 30*a* form a first upper end strap or wall 28*a*/30*a* secured to each other via the first securing panel 32*a*. The first securing panel 32*a* has the effect of hinging second end closure panel 28*a* to the third end closure panel 30*a*. Likewise, the first and fourth end closure panels 26*a*, 34*a* form a first lower end strap or wall 26*a*/34*a* secured to each other via the second securing panel 36*a*. The second securing panel 36*a* has the effect of hinging first end closure panel 26*a* to the fourth end closure panel 34*a*. The arrangement of the first upper end wall 28*a*/30*a* and first lower end wall 26*a*/34*a* being substantially similar to that of the second upper end wall 28*b*/30*b* and second lower end wall 26*b*/34*b* described in the preceding paragraphs.

The embodiments of the present disclosure provide a carton 90 for packaging one or more articles. The carton 90 comprises a plurality of walls which extend at least partially around, or define, an interior of the carton 90. The plurality of walls includes at least one of a top and bottom wall 18, 12/24; that is to say a top wall 18 or a bottom wall 12/24 or a top and bottom wall 18, 12/24. The plurality of walls includes a pair of opposed side walls and a pair of opposed end walls. Each of the side walls has opposed upper and lower edges. The upper edge of the first side wall 14/16 is defined by the fold line 17, the lower edge of the first side wall 14/16 is defined by the fold line 13. The upper edge of the second side wall 20/22 is defined by the fold line 19, the lower edge of the second side wall 20/22 is defined by the fold line 23. The upper edges of the side walls are disposed at a first distance d1 from each other (as shown in FIG. 4), the lower edges of the side walls are disposed at a second distance d2 from each other. The first distance d1 is substantially different from the second distance d2. Optionally first distance d1 is smaller than the second distance d2. Each of the end walls comprises an upper end strap 28*a*/30*a*, 28*b*/30*b* and a lower end strap 26*a*/34*a*, 26*b*/34*b*. Each lower end strap 26*a*/34*a*, 26*b*/34*b* is separate from, and has no direct connection with, the adjacent one of the upper end straps. Each of the at least one of the top and bottom walls 16, 12/24, the upper end straps 28*a*/30*a*, 28*b*/30*b* and the lower end straps 26*a*/34*a*, 26*b*/34*b* is provided with a centre fold line 37, 31*a*, 35*a*, 31*b*, 35*b* such that the carton 90 is collapsible into a flat collapsed form by folding the at least one of the top and bottom walls 18, 12/24, the upper end straps 28*a*/30*a*, 28*b*/30*b* and the lower end straps 26*a*/34*a*, 26*b*/34*b* about their respective centre fold lines 37, 31*a*, 35*a*, 31*b*, 35*b*.

The carton 90 may be automatically erected from the flat collapsed state to form a sleeve open at one end and closed at the other opposing end. The carton 90 may comprise at least one panel 12/24 for at least partially closing the open end once the sleeve is loaded with one or more articles.

Each upper end strap 28*a*/30*a*, 28*b*/30*b* may comprise: a first upper end closure panel 28*a*, 28*b*, (also referred to herein as the second and sixth end closure panels 28*a*, 28*b*), hinged to the first side wall 14/16; a second upper end closure panel 30*a*, 30*b*, (also referred to herein as the third and seventh end closure panels 30*a*, 30*b*), hinged to the second side wall 20/22; and an upper strap securing panel 32*a*, 32*b*, (also referred to herein as the first and third securing panels 32*a*, 32*b*), hingedly connected to one of the first and second upper end closure panels 28*a*, 28*b*, 30*a*, 30*b* by a centre fold line 31*a*, 31*b*.

Each lower end strap 26*a*/34*a*, 26*b*/34*b* may comprise a first lower end closure panel 26*a*, 26*b*, (also referred to herein as the first and fifth end closure panels 26*a*, 26*b*), hinged to the first side wall 14/16; a second lower end panel 34*a*, 34*b* (also referred to herein as the fourth and eighth end closure panels 34*a*, 34*b*), hinged to the second side wall 20/22; and a lower strap securing panel (also referred to herein as the second and fourth securing panels 36*a*, 36*b*), hingedly connected to one of the first and second lower end closure panels by a centre fold line 35*a*, 35*b*.

In some embodiments the panels forming the upper end strap 28*a*/30*a*/32*a*, 28*b*/30*b*/32*b* may be hinged connected to each other in a linear series. Each linear series may hingedly connected at one end to one of the first or second side walls 14/16, 20/22 by one of the end closure panels 28*a*, 30*a*, 28*b*, 30*b*. The securing panels 32*a*, 32*b* may be secured to the other one of first or second side walls 14/16, 20/22. Similarly, the panels forming the lower end strap 26*a*/34*a*/36*a*, 26*b*/34*b*/36*b* may be hinged connected to each other in a linear series. Each linear series may hingedly connected at one end to one of the first or second side walls 14/16, 20/22 by one of the end closure panels 26*a*, 34*a*, 26*b*, 34*b*. The securing panels 36*a*, 36*b* may be secured to the other one of first or second side walls 14/16, 20/22. In the blank of such embodiments one of the first or second side walls 14/16, 20/22 may be free from hinged connection to end closure panels such that said one of the first or second side walls 14/16, 20/22 comprises a pair of opposed free end edges.

Each upper end strap 28*a*/30*a*, 28*b*/30*b* may be shaped and arranged to avoid collision with the adjacent lower end strap 26*a*/34*a*, 26*b*/34*b* when the carton 90 is erected from its flat collapsed form.

Each upper end strap 28*a*/30*a*, 28*b*/30*b* may be shaped and arranged to partially overlap with the adjacent lower end strap 26*a*/34*a*, 26*b*/34*b* when the carton 90 is erected.

It can be appreciated that various changes may be made within the scope of the present invention. For example, the size and shape of the panels and apertures may be adjusted to accommodate articles of differing size or shape. In alternative embodiments the first, second, third and fourth securing panels 32*a*, 36*a*, 32*b*, 36*b* may be reduced in size so as to only partially overlap (rather than fully overlap as shown in the illustrated embodiment) with the respective end closure panel 26*a*, 28*a*, 26*b*, 28*b* to which they are secured.

Whilst the foregoing embodiments have been described with reference to a fully enclosed carton it is envisaged that the features of the carton may be employed in cartons of alternative design such as, but not limited to, wraparound style cartons, basket carries and top gripping clips.

It will be recognised that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

The invention claimed is:

1. A carton for packaging one or more articles, the carton comprising a plurality of walls which extend at least partially around an interior of the carton, the plurality of walls including at least one of top and bottom walls; a pair of opposed side walls; and a pair of opposed end walls, each of said side walls having opposed upper and lower edges, the upper edges of the side walls being disposed at a first distance (d1) from each other, the lower edges of the side walls being disposed at a second distance (d2) from each other, the first distance (d1) being substantially different to the second distance (d2), wherein each of the end walls comprises an upper end strap and a lower end strap, each lower end strap is separate from, and has no direct connection with, the adjacent one of the upper end straps, and wherein each of the at least one of top and bottom walls, the upper end straps and the lower end straps is provided with a centre fold line such that the carton is collapsible into a flat collapsed form by folding the at least one of top and bottom wall, the upper end straps and the lower end straps about their respective centre fold lines.

2. A carton according to claim 1, wherein the at least one of top and bottom walls comprises a top wall and wherein the upper edge of a first side wall is defined by a first fold line between the first side wall and the top wall.

3. A carton according to claim 1, wherein the at least one of top and bottom walls comprises a bottom wall and wherein the lower edge of a first side wall is defined by a second fold line between the first side wall and the bottom wall.

4. A carton according to claim 1, wherein the at least one of top and bottom walls comprises a top wall and wherein an upper edge of a second side wall is defined by a third fold line between the second side wall and the top wall.

5. A carton according to claim 1, wherein the at least one of top and bottom walls comprises a bottom wall and wherein the lower edge of a second side wall is defined by a fourth fold line between the second side wall and the bottom wall.

6. A carton according to claim 1, wherein the first distance (d1) is smaller than the second distance (d2).

7. A carton according to claim 1, wherein each of the upper end straps comprises: a first upper end closure panel; a second upper end closure panel; an upper strap securing panel; and a hinged connection forming a centre fold line.

8. A carton according to claim 1, wherein each of the upper end straps comprises: a first upper end closure panel hinged to the first side wall; a second upper end closure panel hinged to the second side wall; and an upper strap securing panel hingedly connected to one of the first and second upper end closure panels by a centre fold line.

9. A carton according to claim 1, wherein each of the lower end straps comprises: a first lower end closure panel; a second lower end closure panel; a lower strap securing panel; and a hinged connection forming a centre fold line.

10. A carton according to claim 1, wherein each of the lower end straps comprises: a first lower end closure panel hinged to the first side wall; a second lower end closure panel hinged to the second side wall; and a lower strap securing panel hingedly connected to one of the first and second upper end closure panels by a centre fold line.

11. A carton according to claim 1, wherein each of the upper end straps is shaped and arranged to avoid collision with the adjacent lower end strap when the carton is erected from its flat collapsed form.

12. A carton according to claim 1, wherein each of the upper end straps is shaped and arranged to partially overlap with the adjacent lower end strap when the carton is erected.

13. A blank for forming a carton, the blank comprising a plurality of panels for defining an interior chamber for receiving one or more articles, the plurality of panels including at least one of top and bottom panels; and a pair of opposed side panels; each of the side panels having opposed upper and lower edges, the upper edges of the side panels being disposed at a first distance (d1) from each other in a setup carton, the lower edges of the side panels being disposed at a second distance (d2) from each other in a setup carton, the first distance (d1) being substantially different to the second distance (d2), wherein the blank comprises end closure panels for forming an upper end strap and a lower end strap at each end of the setup carton, each of the lower end straps is separate from, and has no direct connection with, the adjacent one of the upper end straps, and wherein each of the at least one of top and bottom panels, the upper end straps and the lower end straps is provided with a centre fold line such that the setup carton is collapsible into a flat collapsed form by folding the at least one of top and bottom panels, the upper end straps and the lower end straps about their respective centre fold lines.

* * * * *